US006171070B1

(12) United States Patent
Mitake

(10) Patent No.: US 6,171,070 B1
(45) Date of Patent: Jan. 9, 2001

(54) HIGH-PRESSURE RECIPROCATING PUMPS

(75) Inventor: Kazutoshi Mitake, Tokyo-to (JP)

(73) Assignee: Hakusu Tech Co., Ltd., Osaka-fu (JP)

( * ) Notice: Under 35 U.S.C. 154(b), the term of this patent shall be extended for 0 days.

(21) Appl. No.: 09/074,217

(22) Filed: May 7, 1998

(30) Foreign Application Priority Data

May 9, 1997 (JP) ..... 9-119849
May 9, 1997 (JP) ..... 9-119850
May 9, 1997 (JP) ..... 9-119851

(51) Int. Cl.[7] ..... F04B 1/04

(52) U.S. Cl. ..... 417/273; 123/45 A; 417/63; 417/454; 417/552; 417/254; 417/490; 417/3; 92/128; 134/10; 415/168.2; 403/13; 277/815; 277/230; 206/318

(58) Field of Search ..... 417/63, 454, 552, 417/254, 490, 3, 273; 92/128; 134/10; 415/168.2; 403/13; 277/815, 230; 206/318; 123/45 A

(56) References Cited

U.S. PATENT DOCUMENTS

| | | | | |
|---|---|---|---|---|
| 2,726,887 | | 12/1995 | Pierotti . | |
| 3,135,219 | | 6/1964 | Hays et al. . | |
| 3,817,663 | * | 6/1974 | Zehner | 417/569 |
| 3,849,032 | * | 11/1974 | Mulvey et al. | 417/454 |
| 3,955,673 | * | 5/1976 | Fosness | 206/318 |
| 4,033,701 | * | 7/1977 | Labyer et al. | 403/13 |
| 4,160,626 | | 7/1979 | Bell . | |
| 4,306,728 | * | 12/1981 | Huperz et al. | 277/125 |
| 4,370,103 | * | 1/1983 | Tripp | 417/298 |
| 4,551,077 | * | 11/1985 | Pacht | 417/454 |
| 4,667,969 | * | 5/1987 | Suggs, III | 277/230 |
| 4,768,933 | * | 9/1988 | Stachowiak | 417/454 |
| 4,790,236 | | 12/1988 | MacDonald et al. . | |
| 4,878,815 | * | 11/1989 | Stachowiak | 417/63 |
| 4,921,409 | * | 5/1990 | Besic | 417/552 |
| 5,020,809 | * | 6/1991 | Mullaney | 277/81 S |
| 5,102,309 | * | 4/1992 | Spehr | 417/490 |
| 5,171,136 | | 12/1992 | Pacht . | |
| 5,253,981 | * | 10/1993 | Yang et al. | 417/3 |
| 5,253,987 | * | 10/1993 | Harrison | 417/566 |
| 5,411,380 | * | 5/1995 | Bristol et al. | 417/454 |
| 5,482,432 | * | 1/1996 | Paliwoda et al. | 415/168.2 |
| 5,488,896 | * | 2/1996 | Current | 92/129 |
| 5,507,219 | | 4/1996 | Stogner . | |
| 5,688,110 | * | 11/1997 | Djordjevic | 417/254 |
| 5,715,740 | * | 2/1998 | Sims | 92/128 |
| 5,743,969 | * | 4/1998 | Lawler | 134/10 |
| 5,778,759 | * | 7/1998 | Johnson | 92/129 |
| 5,850,810 | * | 12/1998 | Strieber et al. | 123/45 A |
| 5,888,054 | * | 3/1999 | Djordjevic | 417/254 |

* cited by examiner

*Primary Examiner*—Charles G. Freay
*Assistant Examiner*—Steven Brown
(74) *Attorney, Agent, or Firm*—Jordan and Hamburg LLP

(57) ABSTRACT

A high-pressure reciprocating pump is constructed such that a plurality of plungers connected to a driver are made to move back and forth and intake channels or discharge channels are opened and closed by valves in synchronism with movements of the plungers for transferring a fluid under high pressure. This pressure reciprocating pump comprises a plurality of plunger cases in which the plungers are individually inserted, sealing devices for sealing gaps formed between inside surfaces of the plunger cases and the plungers, a supporting frame removably supporting the plunger cases which are arranged parallel to each other, a head plate portion detachably closing foremost ends of the individual plunger cases, thereby forming pumping chambers in which the plungers move back and forth, the head plate portion having internal passages whose openings on one side open into the pumping chambers, and directional control valves fitted to the head plate portion, the directional control valves being individually connected to openings on the other side of the passages.

21 Claims, 8 Drawing Sheets

HIGH-PRESSURE RECIPROCATING PUMPS

BACKGROUND OF THE INVENTION

The present invention relates to high-pressure reciprocating pumps for producing high pressure or superhigh pressure in a liquid phase and, more particularly, pertains to high-pressure reciprocating pumps suited for pressurizing a slurry and transferring it under pressure.

A conventional high-pressure reciprocating pump is constructed such that a plunger is made to move back and forth inside a cylinder, a channel connected to an inlet pipe or a discharge pipe is opened and closed by a valve in synchronism with movements of the plunger to vary the volume of a fluid within a pumping chamber, and the fluid is thereby transferred to a high-pressure side.

This type of high-pressure reciprocating pumps is used for cleaning wastewater gutters in chemical plants, food processing plants and buildings, for cleaning ships, and for maintaining and cleaning civil engineering and construction machines. Also, these pumps are incorporated in such equipment as water-jet cutting machines or electronic parts cleaning systems.

FIGS. 8A and 8B illustrate a general construction of a high-pressure reciprocating pump mainly comprising a crankshaft 61 provided inside a crankshaft case 60, a connecting rod 62 whose one end is connected to the crankshaft 61, a plunger 64 which is connected to the other end of the connecting rod 62 and moves back and forth inside a cylinder 63, and a valve case 65 which is affixed to a foremost end of the crankshaft case 60, closing its opening.

The plunger 64 moves to the left in each intake stroke of the pump as shown in FIG. 8A. As the inner volume of the valve case 65 increases corresponding to the amount of leftward movement of the plunger 64, the internal pressure of the valve case 65 is reduced. Forced by atmospheric pressure, a fluid is drawn in through an intake port 66 and introduced into the valve case 65 through an inlet valve 67. In each output stroke, the plunger 64 moves to the right as shown in FIG. 8B and the fluid in a forward part of the plunger 64 pushes an outlet valve 68 to its open position and is discharged through a delivery port 69.

Pressure in a fluid outflow and flow rate vary in the aforementioned construction in which the plunger 64 is made to move back and forth. Generally, this type of construction employs an accumulator to absorb and reduce pressure pulsation which occurs in outflow tubing, or an increased number of cylinders, forming a multi-cylinder structure, in order to increase the number of output strokes per rotation of the crankshaft and thereby produce a more uniform flow.

In the above construction, the plunger 64 is joined to a piston 64*a* to form a single structure by tightening their externally and internally threaded portions together.

The valve case 65 of such conventional high-pressure reciprocating pump is usually a blocklike heavy object which is one-piece formed by metal casting or forging, with a pressurizing chamber 65*a,* an intake channel 65*b* and a discharge channel 65*c* formed in the valve case 65 in a complex configuration by carrying out precision cutting operation using a machine tool. This makes it difficult to create each pressurizing chamber and valve section. Especially when assembling a multi-cylinder type reciprocating pump or disassembling it for servicing, no matter whether it is relatively small, more than one worker and a crane are required to handle the pump and great care must be taken not to break or otherwise damage any plungers or packing, because its valve case is a heavy object incorporating multiple pressurizing chambers and valve sections. Thus, one problem of the conventional construction is poor labor efficiency. Another problem is that the whole valve case must be removed from the crankshaft case.

Furthermore, in the conventional valve case 65 in which the pressurizing chamber 65*a,* the intake channel 65*b* and the discharge channel 65*c* are formed by cutting operation, the intake channel 65*b* or the discharge channel 65*c* is made perpendicular to the pressurizing chamber 65*a* and, therefore, edges are formed where the pressurizing chamber 65*a* and the intake channel 65*b* or the discharge channel 65*c* adjoin. If such edges are exposed to high-pressure or superhigh-pressure pulsating fluid flows when the high-pressure reciprocating pump is in operation, low-cycle fatigue fracture is likely to occur from the edges, eventually causing a breakdown of the valve case 65.

It might be possible to employ a more expensive high-strength material or a rigid material which has been treated by a quench hardening process, for example, to avoid such breakdown. This would, however, make it infeasible to reduce the weight of the valve case 65 and its machining and handling would become more difficult.

The driving piston 64*a* and the plunger 64 are joined together to form a single structure as stated above. For this reason, extremely high accuracy is required to provide good sealing for the plunger 64 when the pressurizing chamber 65*a* is formed by assembling the crankshaft case 60 and the valve case 65.

To achieve such high accuracy in assembling the heavy high-pressure reciprocating pump, however, an extremely high level of skill has been required. Although this does not cause any serious problem if the plunger 64 is made of metal, there arises a problem that the plunger 64 could easily break if it is of a type coated with such fragile material as ceramics and is not properly centered with respect to the piston 64*a* due to poor positioning accuracy. Furthermore, low-accuracy centering of the plunger 64 could cause eccentric wear of its sealing device, resulting in a shortened useful life of sealing and deterioration of the reliability of the high-pressure reciprocating pump.

Another problem potentially encountered with this type of high-pressure reciprocating pump is that leakage could occur at sealing of sliding parts of the pump when transferring a pressurized slurry, especially a slurry containing an inorganic substance.

SUMMARY OF THE INVENTION

It is an object of the present invention to provide a high-pressure reciprocating pump which has overcome the problems residing in the conventional high-pressure reciprocating pumps.

According to an aspect of the invention, a high-pressure reciprocating pump is such that a plunger connected to a driver is made to move back and forth and an intake channel or a discharge channel is opened and closed by a valve in synchronism with movements of the plunger for transferring a fluid under high pressure. This high-pressure reciprocating pump comprises a pressurizing case having in its internal space a pumping chamber and accommodating the plunger, and a directional control valve detachably fitted to the pressurizing case to control fluid intake and discharge operations.

According to another aspect of the invention, a high-pressure reciprocating pump is such that a plurality of plungers connected to a driver are made to move back and forth and intake channels or discharge channels are opened and closed by valves in synchronism with movements of the plungers for transferring a fluid under high pressure. This pressure reciprocating pump comprises a plurality of plunger cases in which the plungers are individually inserted, sealing devices for sealing gaps formed between inside surfaces of the plunger cases and the plungers, a supporting frame removably supporting the plunger cases which are arranged parallel to each other, a head plate portion detachably closing foremost ends of the individual plunger cases, thereby forming pumping chambers in which the plungers move back and forth, the head plate portion having internal passages whose openings on one side open into the head plate portion, the directional control valves being individually connected to openings on the other side of the passages.

These and other objects, features and advantages of the invention will become more apparent upon reading the following detailed description in conjunction with the accompanying drawings.

DETAILED DESCRIPTION OF THE PREFERRED EMBODIMENT OF THE INVENTION

A preferred embodiment of the invention is now described with reference to the accompanying drawings.

Figure 1A:
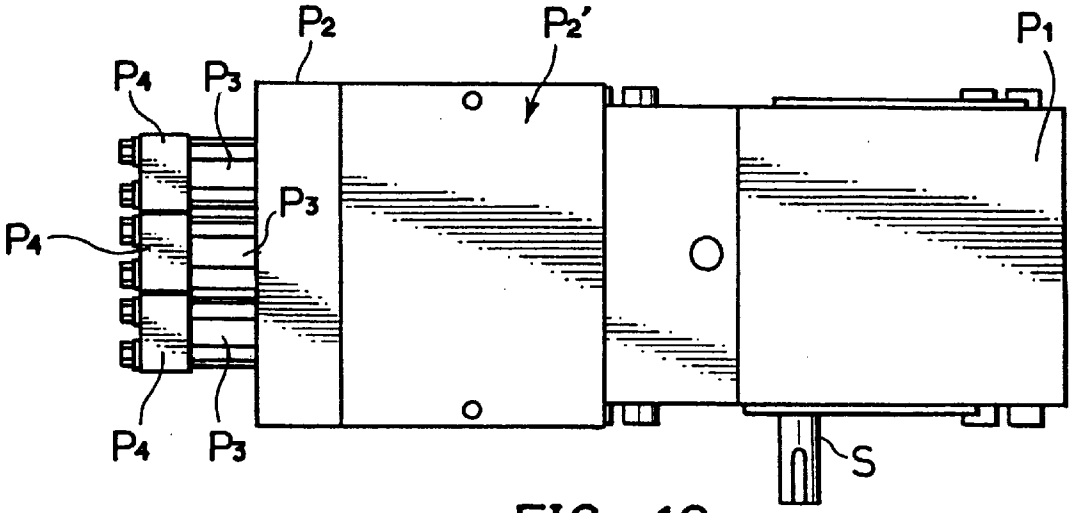
FIGS. 1A to 1C are diagrams showing external appearance of a high-pressure reciprocating pump according to a preferred embodiment of the invention.
Figure 1C:
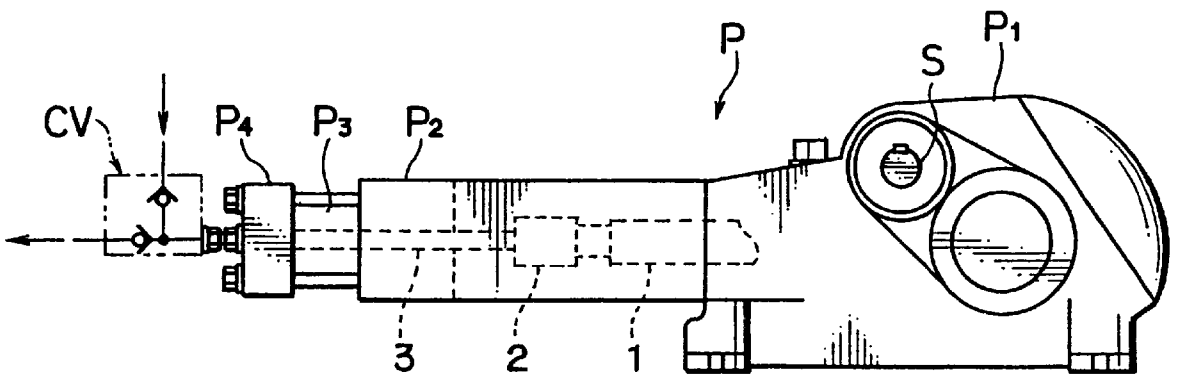

FIGS. 1A and 1C are diagrams showing external appearance of a high-pressure reciprocating pump P according to the invention.

Figure 1B:
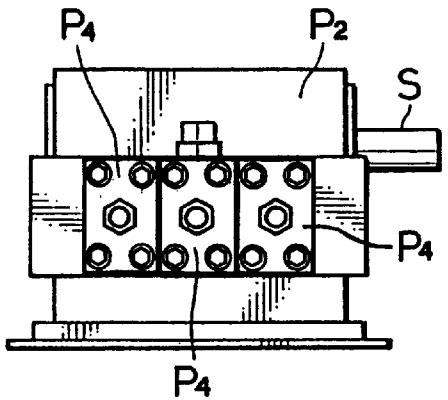

As shown in FIGS. 1A to 1C, the high-pressure reciprocating pump P mainly comprises a driving crankshaft case portion (driver) $P_1$ which receives motive power through an input shaft S, a supporting frame portion $P_2$ provided on a piston side of the driving crankshaft case portion $P_1$, three head plate portions $P_4$ for individually fixing three parallel-arranged plunger case portions $P_3$, and check valve portions CV which are connected to the individual head plate portions $P_4$ and serve as directional control valves. In this configuration, each plunger case portion $P_3$ and its corresponding head plate portion $P_4$ may be regarded as constituting a pressurizing case. Designated by the number 1 in Figures is one of pistons, designated by the number 2 is one of the automatic alignment mechanisms, designated by the number 3 is one of plungers, and designated by the number $P_2'$ is a supporting frame cover.

The aforementioned elements of the high-pressure reciprocating pump P are described in greater detail below. As a convention in the following discussion, the pump head side of the high-pressure reciprocating pump P is regarded as front side while its crankshaft case side is regarded as rear side.

Figure 2:
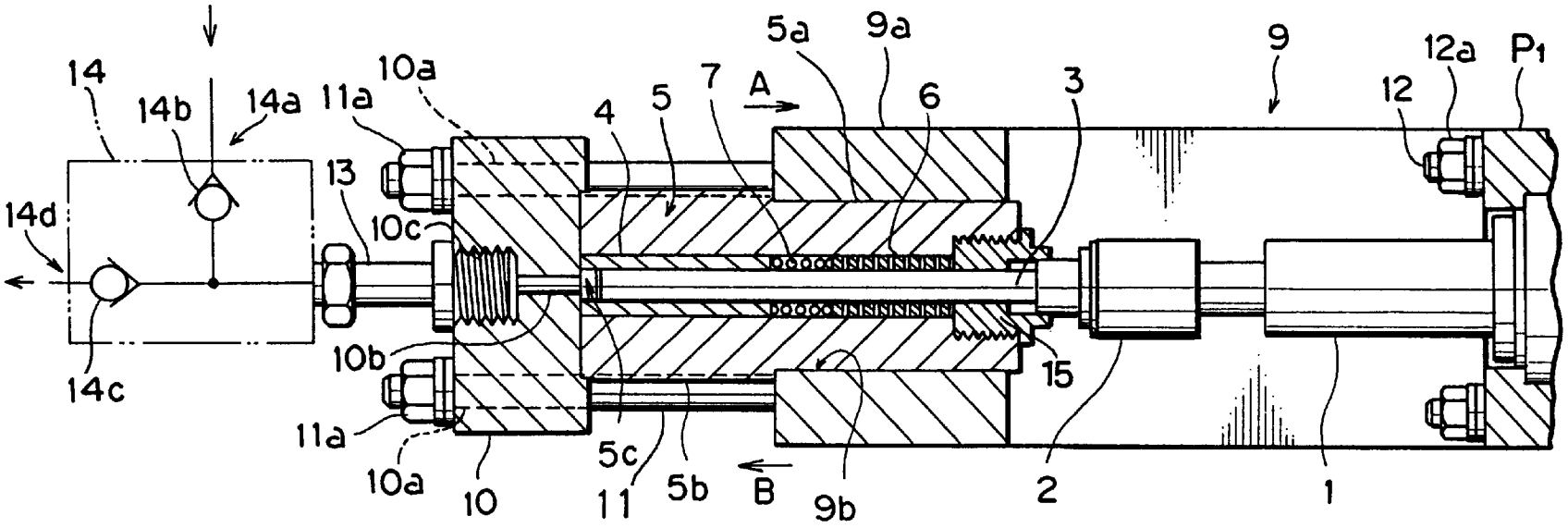
FIG. 2 is a cross-sectional side view showing the construction of a pump head portion of the high-pressure reciprocating pump.

Referring to FIG. 2, a rear end of each piston 1 is connected to a crankshaft (not shown) within the crankshaft case portion $P_1$ by a connecting rod (not shown), while a plunger 3 fitted with a circular cylinder-shaped ceramic sleeve or a circular cylinder-shaped with no sleeve is connected to a front end of each piston 1 by way of an automatic alignment mechanism 2. Preferably, the latter type of plunger 3 is formed of a hard material, such as stainless steel (type SUS440C), alumina, zirconia, sintered hard alloy (e.g., tungsten carbide (WC)), silicon carbide, or silicon nitride. It is to be noted that the piston 1 shown in FIG. 2 is in its top dead point.

In FIG. 2, the plunger 3 is inserted in a hollow cylindrical plunger case 5 with a sleevelike spring stopper 4 fitted between the plunger 3 and the plunger case 5. A seal assembly 6 is fitted in an annular groove formed between a curved inner surface of the plunger case 5 and a curved outer surface of the plunger 3 when the spring stopper 4 is inserted. The seal assembly 6 is forced in the direction of arrow A by a compression coil spring 7 which rests on the spring stopper 4.

Figure 3:
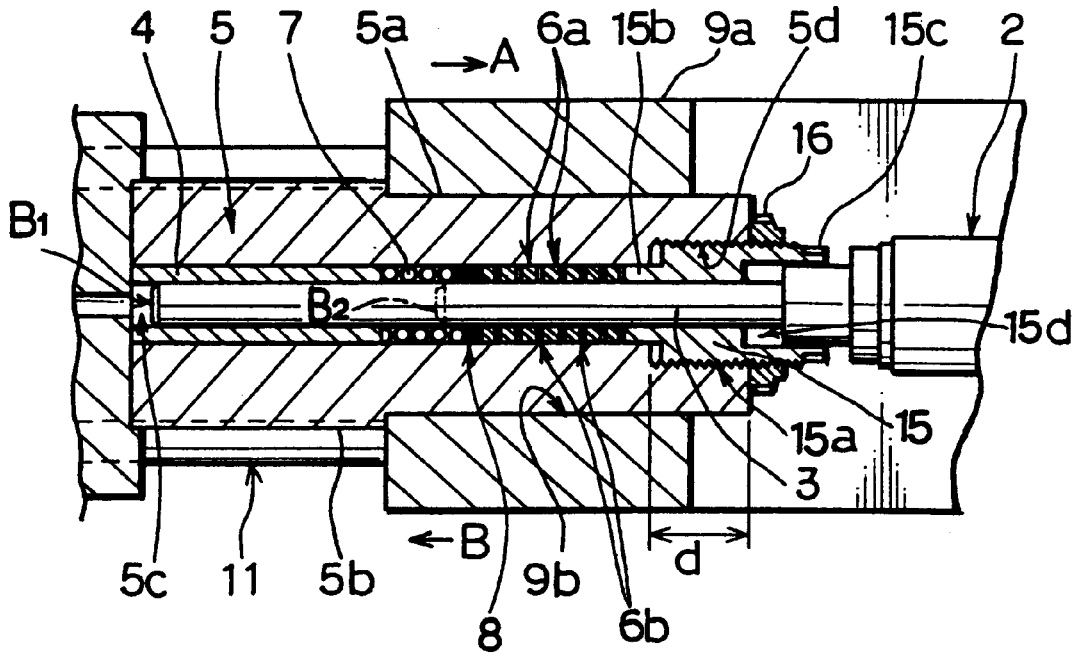
FIG. 3 is a cross-sectional side view showing the construction of a seal assembly and its surrounding parts.

As shown in more detail in FIG. 3, the seal assembly 6 includes a plurality of ramie seals 6*a* serving as gland packing and a plurality of plastic rings 6*b* serving as packing spacers. The ramie seals 6*a* and the plastic rings 6*b* are alternately passed over the plunger 3 to form a laminated stack. Each of the ramie seals 6*a* is a packing element made of a kind of hemp fibers, which are braided into a strip, formed into a closed ring, and impregnated with silicone resin. Since each ring-shaped ramie seal 6*a* is formed from a cut piece of the braided strip of fibers, there is a joint in each ramie seal 6*a* where both ends of the cut piece are spliced with each other. The ramie seals 6*a* are passed over the plunger 3 with an angular displacement of 90 degrees between joints of the successive ramie seals 6*a* so that the joints are not arranged side by side in a line.

The plastic rings 6*b* are ring-shaped elements made of one or more materials having excellent solvent resistance, toughness and moldability chosen from polyether ether ketone, polyethylene, high-density polyethylene, ultrahigh-molecular-weight polyethylene, polyamide, polyacetal, polycarbonate, polyphenylene oxide, polybutylene terephthalate, polysulfone, polyphenylene sulfide, polyamide-imide, fluororesin and silicone resin, for instance. Resin materials actually used for producing the plastic rings 6*b* are determined depending on the type of fluid to be handled by the pump P.

There is placed a spring stopper seat 8 between the spring 7 and the foremost plastic ring 6*b*. According to this construction of the seal assembly 6 employing alternately stacked ramie seals 6*a* and the plastic rings 6*b*, it is possible to transfer a slurry containing an inorganic substance such as alumina or calcium carbonate under pressure under reliable liquid-tight condition in a reliable manner. In FIG. 3, the number $B_1$ indicates the position of a foremost end of the plunger 3 when the piston 1 is located at its top dead point, while the number $B_2$ indicates the position of the foremost end of the plunger 3 when the piston 1 is located at its bottom dead point.

There is formed a threaded hole 5*d* having a depth of "d" in a rear end part of the plunger case 5, and a fastening bolt 15 having a through hole passing along its axis is screwed into the threaded hole 5*d*. In FIG. 3, "d" indicates the depth of the threaded hole 5*d* and a clearance formed between the bottom of the threaded hole 5*d* and a front end of the fastening bolt 15 screwed into the threaded hole 5*d* serves as a tightening margin.

An externally threaded part 15*a* is formed on the fastening bolt 15 that is screwed into the threaded hole 5*d*, and the fastening bolt 15 has a hollow cylindrical part 15*b* projecting beyond the front end of the fastening bolt 15. Fitted into the annular groove formed on the rear side of the seal assembly 6, the hollow cylindrical part 15*b* comes into contact with a rear end of the seal assembly 6, exerting a pushing force against the seal assembly 6 in the direction of arrow B shown in FIG. 3.

The fastening bolt 15 has at its rear end a hexagonal head 15*c* which allows a wrench with a hexagonal end to be fitted for tightening the fastening bolt 15. The head of the fastening bolt 15 need not necessarily be hexagonal, but six or more hooking grooves may be formed around a cylindrical head to permit the use of a spanner hook type wrench. A locknut 16 is screwed on the externally threaded part 15*a* of the fastening bolt 15 until it comes in contact with a rear end surface of the plunger case 5. A deep hole 15*d* is made in the rear end of the fastening bolt 15 to prevent it from interfering with a rear end part of the reciprocating plunger 3.

Figure 4:
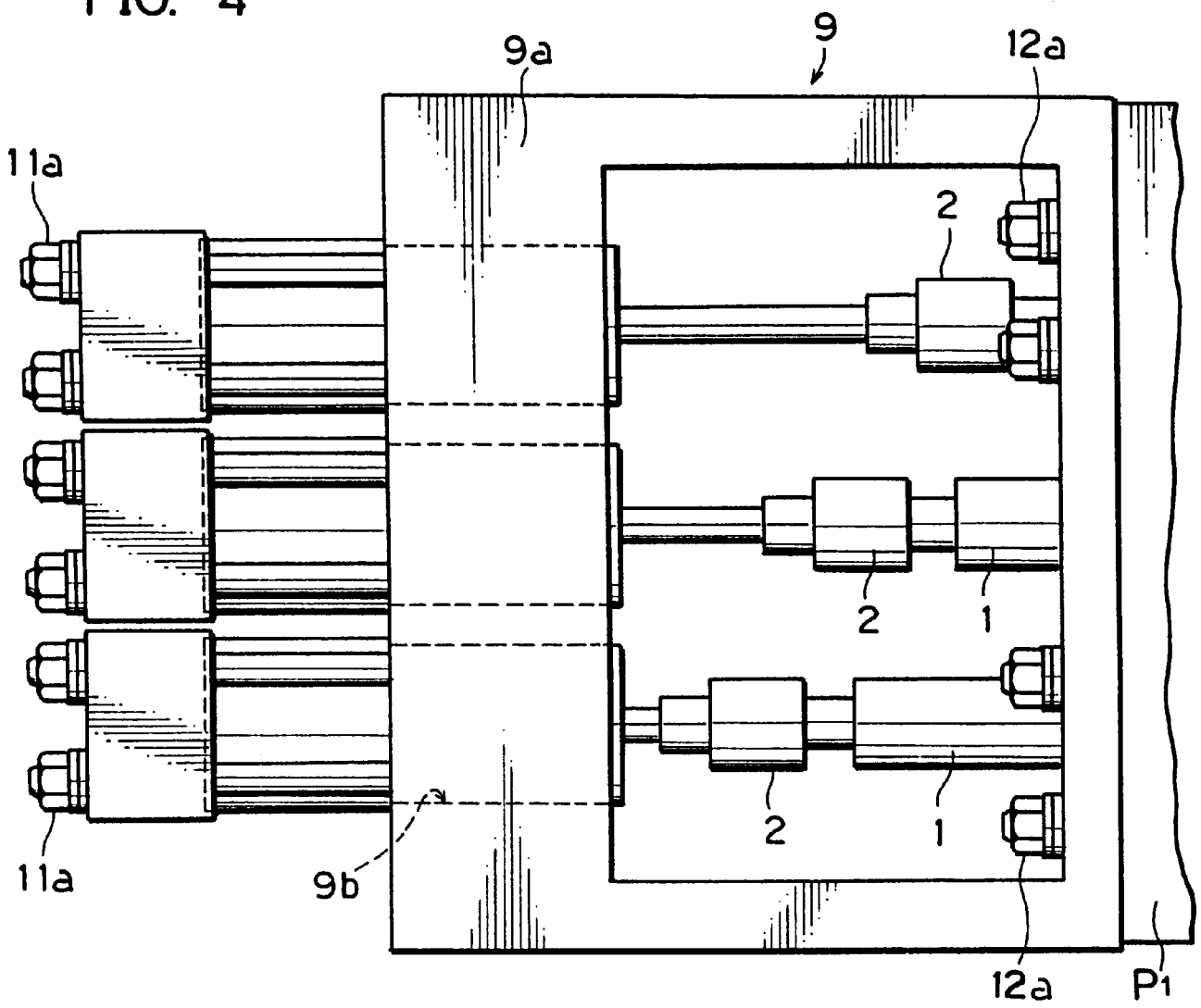
FIG. 4 is a plan view showing the same portion of the high-pressure reciprocating pump as shown in FIG. 2.

FIG. 4 is a plan view showing the high-pressure reciprocating pump P with its supporting frame cover $P_2$' removed. Individual plunger cases 5 are fixed to the crankshaft case portion $P_1$ which is not illustrated in FIG. 4 by way of a window-frame-like supporting frame 9, and the plunger cases 5 are fitted and held in through holes 9*b* formed in a support portion 9*a* of the supporting frame 9.

Specifically, each plunger case 5 is narrowed toward the automatic alignment mechanism 2 (in the direction of the arrow A), forming a stepped structure including a large-diameter portion 5*b* and a small-diameter portion 5*a*, as shown in FIG. 2. The small-diameter portion 5*a* of each plunger case 5 is fitted into its corresponding through hole 9*b* in the support portion 9*a*, with a ringlike rear end surface of the large-diameter portion 5*b* formed at the boundary between the small-diameter portion 5*a* and the large-diameter portion 5*b* resting on a peripheral part of a rear opening of the through hole 9*b*. This stepped structure of the plunger cases 5 determines how deep they are inserted into the supporting frame 9, or serves to set their positions in the supporting frame 9.

There are provided head plates 10 at front ends of the individual plunger cases 5 which are set in position in the supporting frame 9. Each of these head plates 10 is fixed to the support portion 9*a* of the supporting frame 9 by four fixing bolts 11, as if closing the front ends of the respective plunger cases 5.

More particularly, there are made four through holes 10*a* in each head plate 10 for passing the fixing bolts 11 as shown in FIG. 1B. The fixing bolts 11 are passed through the through holes 10*a* in the individual head plate 10 and nuts 11*a* are fitted and fastened onto the fixing bolts 11 with the head plates 10 placed in contact with front end surfaces of the respective plunger cases 5. The support portion 9*a*, the plunger cases 5 and the head plates 10 are assembled in this manner to form a single structure and, as a consequence, a pressurizing chamber is formed in each plunger case 5.

A passage 10*b* is formed in each head plate 10 at a position facing the foremost end of the corresponding plunger 3. One opening of the passage 10*b* in each head plate 10 directly opens into a pumping chamber 5*c* while the other opening of the passage 10*b* is connected to a joint 10*c* to which a later-described valve case 14 is connected.

The valve case 14 is connected to the joint 10*c* by way of a connecting tube 13. Fluid is drawn in from an intake port 14*a* and through a check valve 14*b* when the plunger 3 moves in the direction of the arrow A and is discharged through a check valve 14*a* and a delivery port 14*d* when the plunger 3 moves in the direction of the arrow B.

The individual head plates 10 can be detached from the plunger cases 5 by undoing the nuts 11*a*. If the plunger cases 5 are removed from the support portion 9*a* subsequently, the plungers 3 become exposed. The supporting frame 9 can then be removed from the crankshaft case portion $P_1$ by undoing nuts 12*a* which are fixed to bolts 12 anchored in the crankshaft case portion $P_1$.

The automatic alignment mechanism 2 is now described with reference to FIG. 5. A coupling bolt 20 is joined to the front end of each piston 1 which serves as a drive shaft so that the coupling bolt 20 and the piston 1 are aligned on a common axis. More particularly, the coupling bolt 20 has at its front end a disklike portion 20*a* which serves as a sliding plate and an externally threaded part 20*b* projecting from a rear end. The coupling bolt 20 is fixed to the piston 1 by screwing the externally threaded part 20*b* into a threaded hole 1*a* formed at the front end of the piston 1.

A hollow, generally cylindrical coupling socket nut 21 having a through hole 21*a* in itself is loosely fitted around a shank part of the coupling bolt 20. The diameter of the through hole 21*a* is made larger than the outer diameter of the shank part of the coupling bolt 20 by a specific amount, e.g., 3 millimeters. An inside surface of a flange portion 21*b* of the coupling socket nut 21 comes in contact with a rear end surface of the disklike portion 20*a* of the coupling bolt 20.

A circular cylinder-shaped plunger retainer 22 is fixed to the rear end of the plunger 3 by shrink fit so that the plunger retainer 22 and the plunger 3 are aligned on a common axis. An externally threaded part 22*a* is made around a barrel portion of the plunger retainer 22. The coupling socket nut 21 and the plunger retainer 22 are jointed together by fitting the externally threaded part 22*a* into an internally threaded part of the coupling socket nut 21, whereby the piston 1 and the plunger 3 are connected. The aforementioned coupling socket nut 21 and the plunger retainer 22 can be regarded as constituting a connector.

A projecting part 22*b* whose axis coincides with the axis of the plunger 3 is formed on a rear end surface of the plunger retainer 22 facing the piston 1. This projecting part 22*b* is held in surface-to-surface contact with a front end surface of the disklike portion 20*a*.

Figure 5:
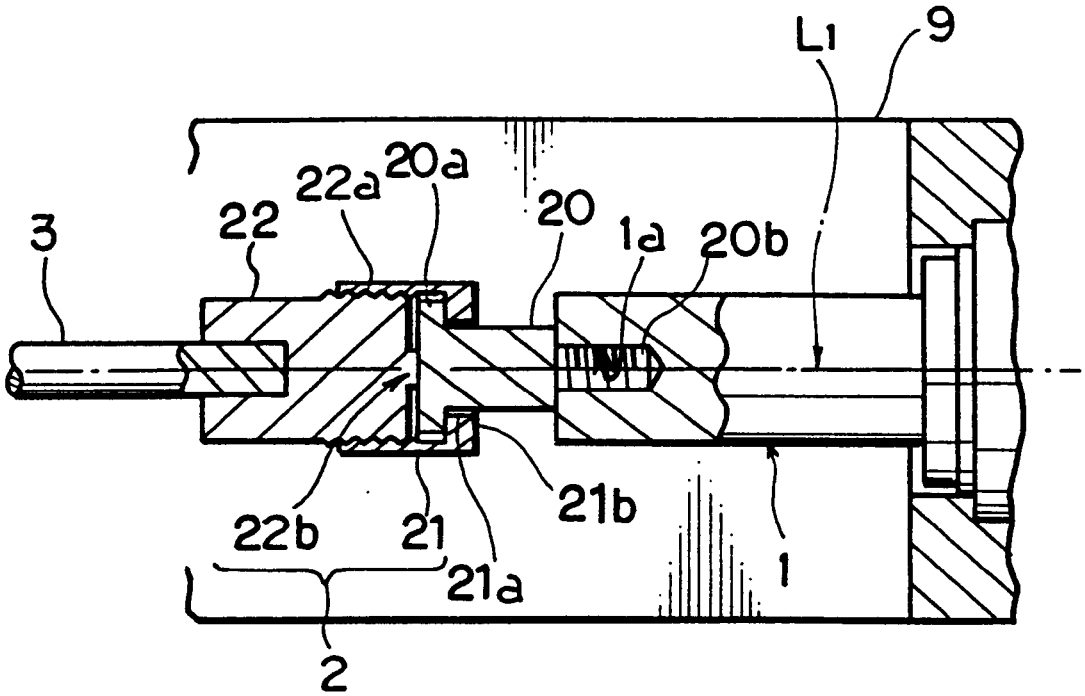
FIG. 5 is a cross-sectional side view showing the construction of an automatic alignment mechanism of FIG. 2.
Figure 6:
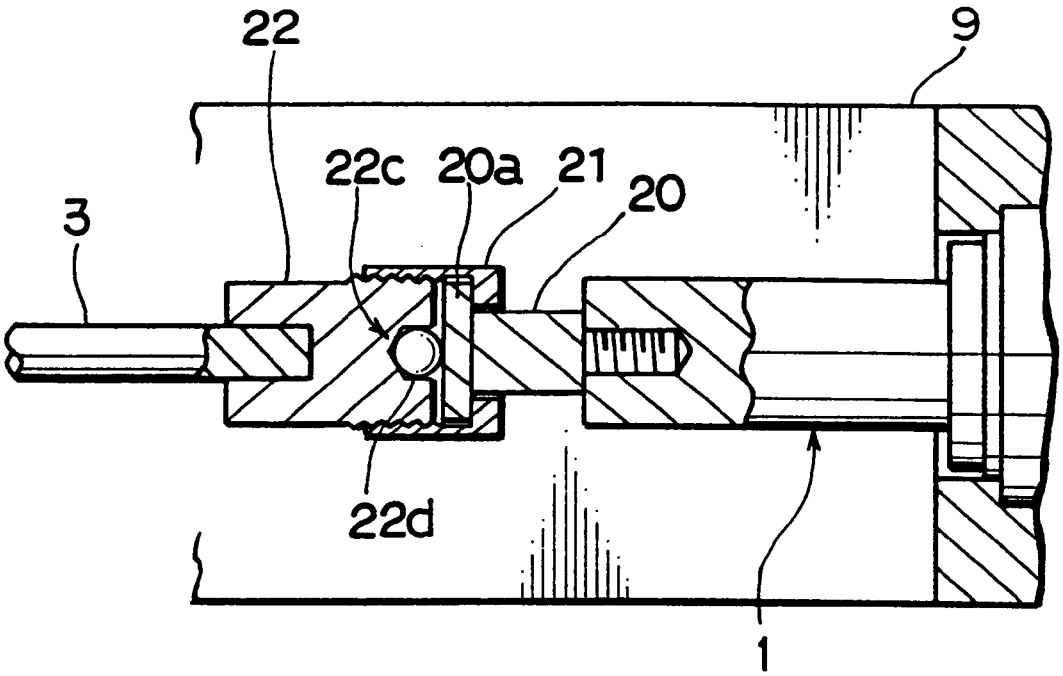
FIG. 6 is a cross-sectional side view showing an automatic alignment mechanism in one varied form of the construction of FIG. 5.

FIG. 6 shows an automatic alignment mechanism in one varied form of the construction of FIG. 5. In the following discussion, elements identical to those shown in FIG. 5 are designated by the same reference numbers and a description of such elements is omitted.

In the automatic alignment mechanism shown in FIG. 6, there is formed a pit 22*c* in a rear end surface of a plunger retainer 22 and a steel ball 22*d* is held within the pit 22*c*, with part of the steel ball 22*d* protruding beyond the edge of the opening of the pit 22*c*. The protruding part of the steel ball 22*d* comes in contact with a front end surface of a disklike portion 20*a* of a coupling bolt 20. In this construction, the plunger retainer 22 and the coupling bolt 20 are pressed against each other with a smaller contact area than in the construction of FIG. 5, or through a point contact.

Figure 7A:
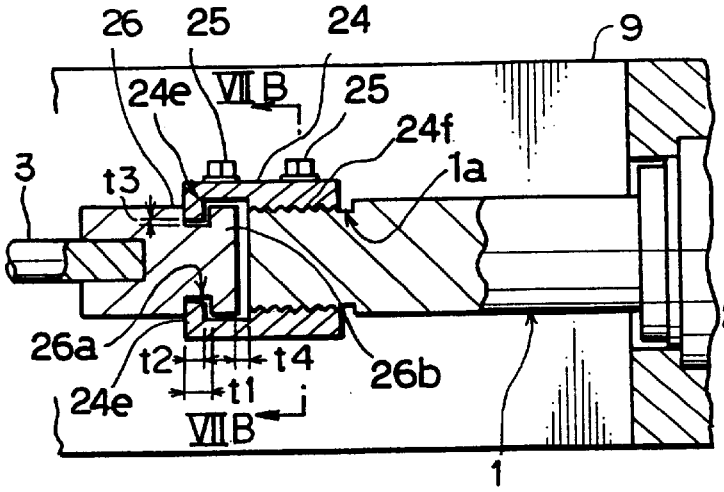
FIG. 7A is a cross-sectional side view showing an automatic alignment mechanism in another varied form of the construction of FIG. 5.
Figure 7B:
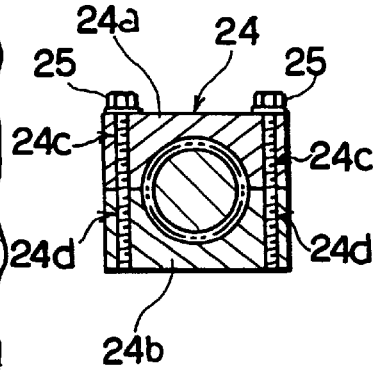
FIG. 7B is a transverse cross-sectional view taken along lines VIIB—VIIB of FIG. 7A.
Figure 8A:
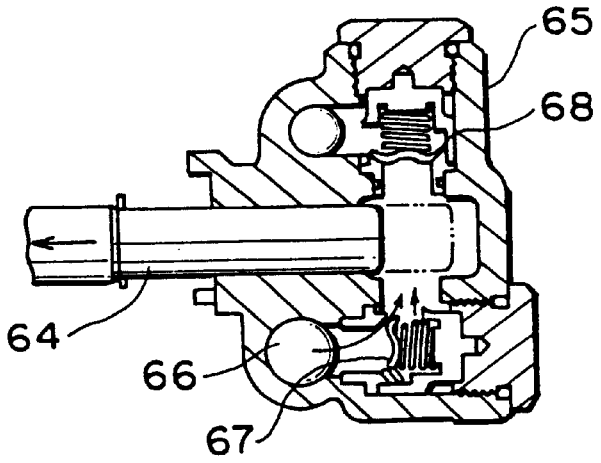
FIG. 8A PRIOR ART
FIGS. 8A and 8B are diagrams showing the construction of a conventional reciprocating pump.
Figure 8B:
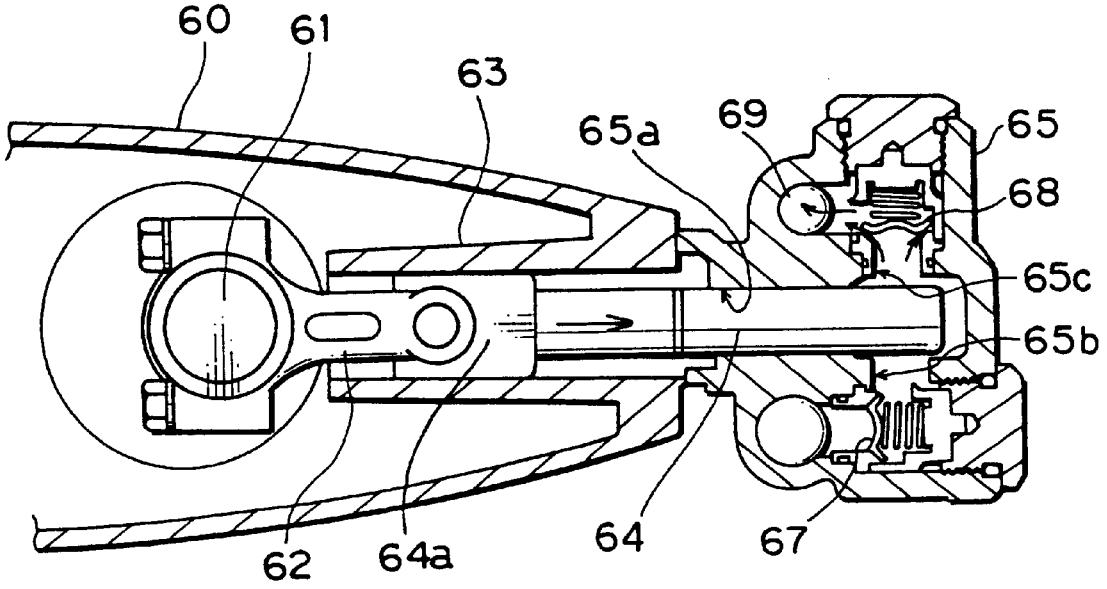
FIG. 8B PRIOR ART

FIGS. 7A and 7B show an automatic alignment mechanism in another varied form of the construction of FIG. 5. This automatic alignment mechanism is suited for a piston 1 having an externally threaded part 1*a* formed at its front end. FIG. 7A is a longitudinal sectional view of the automatic alignment mechanism while FIG. 7B is a transverse cross-sectional view taken along lines VIIB–VIIB of FIG. 7A.

In the construction shown in FIG. 7A and 7B, the externally threaded part 1*a* of the piston 1 is fitted in an internally threaded part 24*f* made in a connecting sleeve 24. The connecting sleeve 24 is formed of two parts, an upper section 24*a* and a lower section 24*b*. A pair of through holes 24*c* are formed in the upper section 24*a* for passing two bolts 25, while a pair of threaded holes 24*d* are formed in the lower section 24*b* at positions corresponding to the through holes 24*c* so that the bolts 25 can be screwed into the threaded holes 24*d*. When the upper and lower sections 24*a*, 24*b* are joined together, the internally threaded part 24*f* of the connecting sleeve 24 engages the externally threaded part 1*a* of the piston 1.

The connecting sleeve 24 also has a hooking part 24*e* which extends inward from a front end of the connecting sleeve 24. The hooking part 24*e* forms a circular opening as seen along the longitudinal axis of the connecting sleeve 24 and an L shape in its longitudinal cross section.

On the other hand, an annular groove 26*a* is formed in a plunger retainer 26 close to its rear end. As the hooking part 24*e* of the connecting sleeve 24 is fitted into the annular groove 26*a*, a plunger 3 is connected to the piston 1 with certain amounts of play, or a free space for unimpeded motion. Specifically, there is formed a clearance of about 3 millimeters between the connecting sleeve 24 and the plunger retainer 26, for example. Further, if the width $t_1$ of the annular groove 26*a* is 10 millimeters, the thickness $t_2$ of the hooking part 24*e* is set to 9.7 to 9.8 millimeters so that the clearance $t_3$ between the hooking part 24*e* and the annular groove 26*a* becomes 0.2 to 0.3 millimeters. It is preferable to provide a clearance of about 1 millimeter between the plunger retainer 26 and the front end of the piston 1. It will be recognized from the above discussion that this automatic alignment mechanism has the play in both axial and radial directions of the piston 1.

Since the plunger 3 and the piston 1 are connected with a free space in between, their assembly is much easier than the constructions shown in FIGS. 5 and 6, and there is no need for conventional processes of temporary assembling, running-in and final tightening in the construction of FIGS. 7A and 7B. Moreover, it is almost unnecessary to care about dimensional errors in component production and assembly errors (e.g., concentricity and straightness errors) and, therefore, the automatic alignment mechanism can be assembled easily and reliably not only by skilled but also by unskilled workers. There is formed a circular flange portion 26*b* which serves as a sliding plate at the rear side of the annular groove 26*a*, and the hooking part 24*e* slides over a surface of the flange portion 26*b*.

Although a socket-like metallic female fitting (21, 24) is joined to each piston 1 while a plug-like metallic male fitting (22, 26) is joined to each plunger 3 in the foregoing embodiment of the invention and variations thereof, this configuration may be reversed.

Operation of the high-pressure reciprocating pump P employing the aforementioned construction is now described.

Referring to FIG. 2, the plunger 3 moves in the direction of the arrow A and the volume of the pumping chamber 5*c* is increased in an intake stroke. In this stroke, the check valve 14*b* opens and the fluid is drawn in from the intake port 14*a* and introduced into the pumping chamber 5*c*. The check valve 14*c* is in its closed position in the intake stroke.

In a subsequent compression stroke, the plunger 3 moves in the direction of the arrow B and the volume of the pumping chamber 5*c* is reduced. As a result, the pressure inside the pumping chamber 5*c* increases and the check valve 14*c* opens so that the fluid is transferred under pressure through the delivery port 14*d*. The check valve 14*b* is in its closed position in the compression stroke.

Since a plunger case and a valve case constituting a pressurizing chamber are one-piece formed in the earlier described conventional high-pressure reciprocating pump, it is necessary to dismantle its valve portion and plunger portion in this order when disassembling the pump for repair, inspection or routine servicing. To dismantle the valve portion of the conventional high-pressure reciprocating pump, blind plugs are removed from the valve portion by using a socket wrench and a valve assembly is removed from a manifold by using pliers, for instance. The valve case can be taken off the crankshaft case only when all nuts of the manifold have been removed from the crankshaft case. In this disassembling process, great care must be taken so as not to break or otherwise damage plungers, packings or any other components with the manifold.

Also when installing the valve case thus removed, it must be positioned with great care so that the plungers projecting from the crankshaft case are properly inserted into respective plunger guiding cylinders of the plunger case, and then the plungers, the packings and the other components must be carefully assembled so as not to damage them.

In the high-pressure reciprocating pump P of this embodiment, however, a pressurizing chamber and a valve case 14 are formed separately from each other for each of the plungers 3. Accordingly, if it becomes necessary to disassemble and inspect the reciprocating pump P due to a pressure drop in a particular discharge channel, for example, only a relevant valve case 14 need to be taken off from its plunger case 5 for inspection, and when the need arises, the relevant pressurizing chamber can be disassembled after removing it from the crankshaft case portion $P_1$. Unlike the conventional construction, it is not always necessary to remove the whole valve case from the crankshaft case and the plungers 3 can be individually aligned with the respective plunger cases 5 by the automatic alignment mechanisms 2 in this embodiment. It would therefore be understood that assembling and disassembling operation can be performed with ease in a shorter time in this invention.

Operation of the automatic alignment mechanism 2 is now described. When installing each plunger case 5 in the supporting frame 9, the plunger retainer 22 to be fitted on the rear end part of the plunger 3 is placed face to face with the coupling socket nut 21 which is loosely fitted over the coupling bolt 20, and the plunger retainer 22 is screwed into the plunger retainer 22 to join the coupling socket nut 21 and the plunger retainer 22 together. The coupling socket nut 21 and the plunger retainer 22 are not completely tightened with each other at this stage, however.

Next, the plunger 3 is inserted into the plunger retainer 22 while fitting the small-diameter portion 5*a* of the plunger case 5 into one of the through holes 9*b* in the supporting frame 9. The seal assembly 6, the compression coil spring 7 and the spring stopper 4 are fitted over the plunger 3 in this order to complete a seal structure.

The piston 1 is made to move back and forth several times in this condition so that the seal assembly 6 is properly set in position around the plunger 3. The coupling socket nut 21 and the plunger retainer 22 are then tightened with each other.

In the high-pressure reciprocating pump P thus assembled, the axis of each piston 1 and that of its corresponding plunger 3 are not necessarily aligned with a theoretical axis line due to machining and assembly errors, for instance. There are two specific error factors that cause this axis misalignment. These are a concentricity error, or parallel displacement of the axis $L_1$ of any piston 1 relative to the axis $L_2$ of its corresponding plunger 3, and a straightness error which occurs when the axis $L_1$ and the axis $L_2$ intersect at an angle at a particular point, as illustrated in FIG. 5. Thus, there arises the need to set a concentricity tolerance, or a maximum, permissible concentricity error, to make it possible to absorb the two error factors. The concentricity tolerance corresponds to a region bounded by the curved outer surface of a circular cylinder having a diameter d and an axis which coincides with a theoretically desired axis line. In this embodiment, d=3 mm and the axial length of the circular cylinder is equal to one reciprocating stroke of each piston 1.

In the construction shown in FIG. 5, the plunger retainer 22 is held in contact with the disklike portion 20*a* of the coupling bolt 20 through the projecting part 22*b* having a small contact area, and there is formed a clearance between the coupling socket nut 21 and the coupling bolt 20. It is therefore possible to maintain deviation of the axes of the piston 1 and the plunger 3 within the aforementioned concentricity tolerance.

Operation of the seal assembly 6 is now described. In the construction of the seal assembly 6 of this invention, when a plunger 3 is fitted in its corresponding plunger case 5, the fastening bolt 15 serving as a tightening device receives the seal assembly 6 with a minimal tightening margin which is sufficient to prevent fluid leakage. When leakage occurs, the pushing force exerted on the seal assembly 6 by the fastening bolt 15 is increased by tightening it until the leakage is stopped.

The useful life of the seal assembly 6 is remarkably extended thanks to this tightening capability. Moreover, because the pushing force exerted on the seal assembly 6 can be gradually increased as its performance deteriorates, it is possible to maintain a stable sealing effect between the inner surface of the plunger case 5 and the plunger 3.

Working of the fastening bolt 15 is described below in greater detail. The fastening bolt 15 is screwed into the fastening bolt 15 after the plunger 3 has been inserted into the plunger case 5 with the seal assembly 6 fitted over the plunger 3. As the fastening bolt 15 is tightened, the seal assembly 6 is gradually compressed by a pushing force exerted by the compression coil spring 7. In this condition, the fastening bolt 15 pushes the seal assembly 6 with a minimal tightening margin which is sufficient to prevent fluid leakage.

When leakage occurs through the seal assembly 6 as a result of continued running of the high-pressure reciprocating pump P, the fastening bolt 15 is tightened with a hexagon head wrench fitted to the hexagonal head 15*c* to gradually increase the pushing force exerted by the fastening bolt 15 until the leakage is completely stopped.

It is also a common practice to tighten seals to stop leakage when it occurs in a conventional sealing structure employing V-packing, for example. The conventional sealing structure, however, has a problem that frictional resistance acting on a plunger sharply increases when a tightening force exerted on a sealing device is increased. This is because one end of the sealing device is fixed by a wall surface in the conventional sealing structure. This means that the conventional sealing structure provides a small tightening margin and, therefore, it is difficult to finely adjust the tightening force.

In this embodiment of the invention, the coil spring 7 is gradually compressed as the seal assembly 6 is tightened, and the pushing force exerted on the seal assembly 6 can be gradually increased within a range of the tightening margin of the fastening bolt 15. The tightening force can be finely adjusted with this large tightening margin.

PRACTICAL EXAMPLE

The high-pressure reciprocating pump of the above-described embodiment of the invention and the earlier-described conventional high-pressure reciprocating pump were tested under the same operating conditions, in which a fluid introduced into both pumps was pressurized and transferred to an external line under pressure. For the purpose of this comparative testing, the pumps were set to produce a pressurizing force of 140 MPa and a discharge rate of 500 liters per hour at a crankshaft rotating speed of 150 r.p.m. It is to be noted that the pressurizing force is 0.1 to 500 MPz and the discharge rate is 10 to 2000 liters per hour according to the specifications of the high-pressure reciprocating pump of the embodiment. The following test conditions were used in the testing:

(1) Type of slurry: Alumina powder mixed in water (2) Density of solid constituent: 50 wt %

(3) Hardness of solid constituent: 1500 Hv (4) Particle size of solid constituent: 100 micrometers (5) Viscosity of slurry: 500 cp Leakage occurred in the conventional high-pressure reciprocating pump after a few minutes of operation at its sliding parts and the pump became inoperative. Contrary to this, the high-pressure reciprocating pump of the invention demonstrated its ability to supply the slurry under pressure in a stable manner for a few hundred hours.

In the high-pressure reciprocating pump of the invention, the valves for controlling fluid intake and discharge operations and the pressurizing chambers for pressurizing the fluid are formed as separate elements and each pump head employs a simple construction in which a plunger reciprocates in tis corresponding cylinder to perform a pressurizing function. Therefore, this high-pressure reciprocating pump can be easily produced and sufficient strength is obtained at those parts of the pump heads which are exposed to high-pressure or superhigh-pressure pulsating fluid flows.

Since the pump heads are separately provided for the individual plungers and the connecting tubes are fitted to the individual head plates to make it possible to connect the valves, the pump heads can be easily removed from and mounted to the crankshaft case and the valves can be easily removed from and fitted to the individual pump heads. This construction serves to simplify manufacture, assembly and disassembly for repair and servicing of the high-pressure reciprocating pump.

Each of the automatic alignment mechanisms absorbs axis misalignment which will occur between a piston and a plunger in which the piston is inserted when the individual pump heads are assembled with the crankshaft case, for instance. This serves to significantly reduce the time required for assembly operation. Since the axis misalignment problem is overcome by the automatic alignment mechanisms, eccentric wear of each sealing device will not occur and, as a consequence, the service life of the high-pressure reciprocating pump will be prolonged.

Among various components constituting the high-pressure reciprocating pump, sealing devices have the shortest useful life and require careful maintenance. If the useful life of each sealing device is prolonged, maintenance work intervals can be shortened, eventually increasing the reliability of the high-pressure reciprocating pump.

Although the supporting frame 9 has a generally rectangular shape in the aforementioned embodiment, it may be formed into any desired shape as long as it is adapted to secure the individual plunger cases 5 to the crankshaft case portion $P_1$.

Although the head plates 10 are provided individually to the plunger cases 5 and the valve cases 14 are connected to the respective head plates 10 in the aforementioned embodiment, the invention is not limited to this construction. In one alternative approach, there may be provided a head plate formed in a single structure which is mounted on all the plunger cases 5. Moreover, it is possible to employ a single-structure valve case incorporating multiple intake and delivery portions corresponding to the individual plungers 3.

The high-pressure reciprocating pump of the aforementioned embodiment is constructed such that the individual plunger cases 5 are positioned in the supporting frame 9 when the rear end surface of the large-diameter portion 5*b* of each plunger case 5 is brought into contact with the peripheral part of the rear opening of the corresponding through hole 9*b* made in the support portion 9*a*. The invention is not limited to this construction. As an alternative, there may be formed counterbores in the support portion 9*a* so that the cylindrical plunger cases 5 are positioned as they are inserted into the through holes 9*b* until they are seated on bottom surfaces of the respective counterbores.

Although the individual head plates 10 are secured to the support portion 9*a* of the supporting frame 9 by the fixing bolts 11 in the aforementioned embodiment, the head plates 10 may be directly fixed to the corresponding plunger cases 5 if the discharge rate of the pump is relatively small, e.g., 100 liters per hour or less.

While the high-pressure reciprocating pump of the invention is suited for transferring a pressurized slurry containing an inorganic substance as mentioned in the above-described practical example, the pump is not limited to this application but is suited for conveying various kinds of fluid under pressure.

As described above, an inventive high-pressure reciprocating pump is constructed such that a plunger connected to a driver is made to move back and forth and an intake channel or a discharge channel is opened and closed by a valve in synchronism with movements of the plunger for transferring a fluid under high pressure. This high-pressure reciprocating pump comprises a pressurizing case having in its internal space a pumping chamber and accommodating the plunger, and a directional control valve detachably fitted to the pressurizing case to control fluid intake and discharge operations.

Also, an inventive high-pressure reciprocating pump is constructed such that a plurality of plungers connected to a driver are made to move back and forth and intake channels or discharge channels are opened and closed by valves in synchronism with movements of the plungers for transferring a fluid under high pressure. This pressure reciprocating pump comprises a plurality of plunger cases in which the plungers are individually inserted, sealing devices for sealing gaps formed between inside surfaces of the plunger cases and the plungers, a supporting frame removably supporting the plunger cases which are arranged parallel to each other, a head plate portion detachably closing foremost ends of the individual plunger cases, thereby forming pumping chambers in which the plungers move back and forth, the head plate portion having internal passages whose openings on one side open into the pumping chambers, and directional control valves fitted to the head plate portion, the directional control valves being individually connected to openings on the other side of the passages.

The high-pressure reciprocating pump is preferably constructed such that the plunger cases are cylinders each having a small-diameter portion and a large-diameter portion, parallel through holes are formed in the supporting frame to permit the small-diameter portions of the cylinders to be fitted therein, and the plunger cases are properly positioned in the supporting frame by inserting the plungers into the supporting frame until a steplike surface formed at a boundary between the small-diameter portion and the large-diameter portion of each cylinder comes into contact with a peripheral part of an opening of the corresponding through hole.

Preferably, a fixing part of the supporting frame is fixed to a case of the driver and the head plate portion is fixed to the supporting frame by means of bolts.

The head plate portion may be formed of a plurality of caplike members which are fixed to the supporting frame for the individual plunger cases or a one-piece formed caplike member which is mounted to cover all the plunger cases.

The high-pressure reciprocating pump is preferably constructed such that the plungers are individually connected to pistons of the driver through automatic alignment mechanisms. In this case, each of the automatic alignment mechanisms preferably includes a sliding plate provided at an end of each piston close to its corresponding plunger or at an end of each plunger close to its corresponding piston, the sliding plate being directed at right angles to the axis of the plunger or the piston, and a coupling device interconnecting the plunger and the piston with loose fit to provide play, wherein the sliding plate allows the end of the plunger or the piston to slide along a surface of the sliding plate.

The coupling device may be formed of a metallic female fitting loosely fitted to the end of each piston close to its corresponding plunger or to the end of each plunger close to its corresponding piston and a metallic male fitting fitted to the end of each plunger close to its corresponding piston or to the end of each piston close to its corresponding plunger, wherein the metallic male fitting is screwed into the metallic female fitting. Preferably, a projecting part is provided at the end of each piston or at the end of each plunger so that the sliding plate slides in contact with the projecting part.

Alternatively, the coupling device may be formed of a metallic female fitting firmly fixed to the end of each piston close to its corresponding plunger or to the end of each plunger close to its corresponding piston, the metallic female fitting having a hooking part, and a metallic male fitting fitted to the end of each plunger close to its corresponding piston or to the end of each piston close to its corresponding plunger, the metallic male fitting having a groove which can engage with the hooking part.

It is preferable that each of the sealing devices is formed of laminating seal members fitted in an annular groove formed between the inside surface of each plunger case and its corresponding plunger, a coil spring mounted between the laminated seal members and a bottom of the annular groove, and a tightening device located at one end of the laminated seal members opposite to the coil spring to press the laminated seal members against a pushing force exerted by the coil spring. The laminated seal members preferably include a plurality of ramie seals and backup rings alternately stacked along the axis of each plunger.

A typical fluid suited for transferring by the inventive high-pressure reciprocating pump under pressure is a slurry based on such a liquid as water, an organic solvent or a chemical solution containing an organic or inorganic substance. Needless to say, the high-pressure reciprocating pumps can be used for pressurizing and transferring various kinds of liquid other than the slurry.

Accordingly, lightweight and highly reliable pump head s can be provided. The pump heads are easy to manufacture and assemble as well as high-pressure reciprocating pumps employing such pump heads. Since pressurizing and valve portions are formed separately from each other, it is possible to simplify the construction of the pump heads. In this construction, only those parts of the pump heads which are exposed to high pressure need to be formed of high-strength materials and, even when such parts have worn out, it is not necessary to replace the whole pump. This makes it possible to reduce manufacturing and running costs of the high-pressure reciprocating pumps.

In a conventional multi-cylinder type reciprocating pump, it has been required to disassemble the whole pump when replacing a seal of only one cylinder. In this invention, however, seal members can be replaced for each individual plunger case so that it is possible to simplify replacement of the seal members, which constitutes almost all of maintenance work required for normal running of the pump.

Since the inventive sealing devices provide a high and stable sealing effect in the high-pressure reciprocating pump, it is possible to pressurize a slurry and transfer it under pressure in a reliable manner, without causing leakage. Even when leakage has occurred, the high sealing effect can be restored by tightening the sealing devices, thereby extending their useful life.

The inventive automatic alignment mechanism absorb axis misalignment between the pistons and their corresponding plungers. Thus, even an unskilled worker can carry out assembly and maintenance of the high-pressure reciprocating pump with ease. Another advantage effect of the use of the automatic alignment mechanisms is that the plungers will not be broken even when they are formed of a fragile ceramic material which is usually expensive. Furthermore, it is possible to eliminate eccentric wear of the sealing devices and extend their useful life, eventually increasing the reliability of the high-pressure reciprocating pump.

What is claimed is:

1. A high-pressure reciprocating pump, comprising:

plungers connected to a driver for movement back and forth;

independent pressurizing cases, each of said independent pressurizing cases including a plunger case and an independent head plate portion detachably mounted to one end of said plunger case, each said plunger case defining a pumping chamber therein and accommodating a respective one of said plungers; and a directional control valve detachably fitted to said head plate portion to control fluid intake and discharge operations, said directional control valve including structure defining an intake channel and a discharge channel, said intake and discharge channels being alternatively opened and closed in synchronism with respective back and forth movements of the plungers for transferring fluid under pressure.

2. A high-pressure reciprocating pump, comprising:

plungers connected to a driver for movement back and forth;

plunger cases in which said plungers are individually inserted;

sealing devices for sealing gaps formed between inside surfaces of said plunger cases and said plungers;

a supporting frame receptively accommodating at least length portions of said plunger cases which are arranged parallel to each other such that said plunger cases are removably supported thereby;

a head plate portion detachably mounted to foremost ends of each of said individual plunger cases, thereby forming pumping chambers in which said plungers move back and forth, said head plate portion having internal passages whose openings on one side open into said pumping chambers; and directional control valves fitted to said head plate portion, said directional control valves being individually connected to openings on the other side of said passages, each of said directional control valves including structure defining an intake channel and a discharge channel, said intake and discharge channels being alternatively opened and closed in synchronism with respective back and forth movements of the plungers for transferring fluid under pressure.

3. A high-pressure reciprocating pump according to claim 2, wherein;

said plunger cases are cylinders each having a small-diameter portion and a large-diameter portion;

parallel through holes are formed in said supporting frame to permit the small-diameter portions of said cylinders to be fitted therein; and said plunger cases are properly positioned in said supporting frame by inserting said plunger cases into said supporting frame until a step-like surface formed at a boundary between the small-diameter portion and the large-diameter portion of each cylinder comes into contact with a peripheral part of an opening of the corresponding through hole.

4. A high-pressure reciprocating pump according to claim 2, wherein:

a fixing part of said supporting frame is fixed to a case of said driver; and said head plate portion is fixed to said supporting frame by means of bolts.

5. A high-pressure reciprocating pump according to claim 2, wherein said head plate portion is formed of a plurality of cap-like members which are fixed to said supporting frame for said individual plunger cases.

6. A high-pressure reciprocating pump according to claim 2, wherein said head plate portion is a one-piece formed cap-like member which is mounted to cover all said plunger cases.

7. A high-pressure reciprocating pump according to claim 2, wherein said plungers are individually connected to pistons of said driver through automatic alignment mechanisms, each of said automatic alignment mechanisms including a sliding plate provided at one of an end of each piston close to its corresponding plunger and at an end of each plunger close to its corresponding piston, said sliding plate being directed at right angles to an axis of said plunger or said piston, and a coupling device interconnecting said plunger and said piston with loose fit to provide play, wherein said sliding plate allows one of the end of said plunger and said piston to slide along a surface of said sliding plate.

8. A high-pressure reciprocating pump according to claim 7, wherein said coupling device includes a metallic female fitting loosely fitted to one of the end of each piston close to its corresponding plunger and to the end of each plunger close to its corresponding piston and a metallic male fitting fitted to one of the end of each plunger close to its corresponding piston and to the end of each piston close to its corresponding plunger, wherein said metallic male fitting is screwed into said metallic female fitting.

9. A high-pressure reciprocating pump according to claim 7, wherein a projecting part is provided at one of the end of each piston and at the end of each plunger so that said sliding plate slides in contact with said projecting part.

10. A high-pressure reciprocating pump according to claim 7, wherein said coupling device includes a metallic female fitting firmly fixed to one of the end of each piston close to its corresponding plunger and to the end of each plunger close to its corresponding piston, said metallic female fitting having a hooking part, and a metallic male fitting fitted to one of the end of each plunger close to its corresponding piston and to the end of each piston close to its corresponding plunger, said metallic male fitting having a groove engageable with said hooking part.

11. A high-pressure reciprocating pump according to claim 2, wherein each of said sealing devices includes laminated seal members fitted in an annular groove formed between the inside surface of each plunger case and its corresponding plunger, a coil spring mounted between said laminated seal members and a bottom of said annular groove, and a tightening device located at one end of said laminated seal members opposite to said coil spring to press said laminated seal members against a pushing force exerted by said coil spring.

12. A high-pressure reciprocating pump according to claim 11, wherein said laminated seal members include a plurality of ramie seals and backup rings alternately stacked along an axis of each plunger.

13. A high-pressure reciprocating pump according to claim 2, wherein said plungers are individually connected to pistons of said driver through automatic alignment mechanisms, each of said automatic alignment mechanisms including a sliding plate detachably mounted to one of an end of each piston close to its corresponding plunger and to an end of each plunger close to its corresponding piston, said sliding plate being directed at right angles to an axis of said plunger or said piston, and a coupling device interconnecting said plunger and said piston with loose fit to provide play, wherein said sliding plate allows one of the end of said plunger and said plunger to slide along a surface of said sliding plate.

14. A high-pressure reciprocating pump, comprising:

plungers connected to a driver for movement back and forth;

plunger cases in which said plungers are individually inserted;

sealing devices for sealing gaps formed between inside surfaces of said plunger cases and said plungers;

a supporting frame removably supporting said plunger cases which are arranged parallel to each other;

a head plate portion detachably closing foremost ends of said individual plunger cases, thereby forming pumping chambers in which said plungers move back and forth, said head plate portion having internal passages whose openings on one side open into said pumping chambers;

directional control valves fitted to said head plate portion, said directional control valves being individually connected to openings on the other side of said passages, each of said directional control valves including structure defining an intake channel and a discharge channel, said intake and discharge channels being alternatively opened and closed in synchronism with respective back and forth movements of the plungers for transferring fluid under pressure; and automatic alignment mechanisms, said plungers being individually connected to pistons of said driver through said automatic alignment mechanisms, each of said automatic alignment mechanisms including a sliding plate detachably mounted to one of an end of each of said pistons close to its corresponding plunger and to an end of each of said plungers close to its corresponding piston, said sliding plate being directed at right angles to an axis of said plunger or said piston, and a coupling device interconnecting said plunger and said piston with loose fit to provide play, wherein said sliding plate allows one of the end of said plunger and said piston to slide along a surface of said sliding plate, wherein said coupling device includes a configuration of each of said pistons which presents an externally threaded part, a mating internally threaded part in a connecting sleeve, the connecting sleeve being formed of two parts, a first part including a pair of through holes and a second part including a pair of threaded holes, a pair of bolts securing the first and second parts, the connecting sleeve further including a hooking part which extends inwardly from one end of the connecting sleeve engaging a complementary sized annular groove formed in one end of a plunger retainer.

15. A high-pressure reciprocating pump, comprising:

individual plunger cases;

a supporting frame including structure adapted to receiving at least an end length portion of each of said plunger cases for removably supporting said plunger cases in generally parallel arrangement to one another;

plungers individually inserted in respective ones of said plunger cases and attachable to a driver for imparting reciprocating movement to said plungers within said plunger cases;

at least one head plate portion detachably mounted to an end of each of said plunger cases distant from said end length portion, each of said plunger cases defining, in combination with said head plate portion, a pumping chamber within which a corresponding one of the plungers reciprocate when driven, said at least one head plate portion including an internal passage in corresponding communication with each said pumping chamber;

a seal interposed between an inside surface of each of said plunger cases and said plungers; and directional control valves, each individually connected with each said passage in communication with a corresponding one of said pumping chambers, each of said directional control valves including structure defining an intake channel and a discharge channel, said intake and discharge channels being alternatingly opened and closed in synchronism with respective back and forth reciprocation movements of the plungers when driven for effecting transfer of fluid under pressure.

16. A high-pressure reciprocating pump according to claim 15, wherein:

said end length portion of each of said plunger cases is cylindrically configured, presenting an outer diameter smaller than a maximum outer dimension of a remainder of each of said plunger cases, thereby forming a shoulder at a boundary of said remainder and said end length portion; and said supporting frame includes parallel through holes formed therein for fittably receiving said end length portions, said plunger cases each being properly positioned in said supporting frame by inserting said end length portion of each of said plunger cases into said supporting frame until said shoulder comes into contact with a peripheral part of an opening of the corresponding one of said through holes.

17. A high-pressure reciprocating pump according to claim 15, wherein said plunger cases, which extend in a position interposed between said head plate portion and said supporting frame, are secured to said supporting frame by bolting said head plate portion to said supporting frame.

18. A high-pressure reciprocating pump according to claim 15, wherein said at least one head plate portion includes individual cap-like members each corresponding to a respective one of said plunger cases and which are independently fixed to said supporting frame.

19. A high-pressure reciprocating pump according to claim 15, wherein said at least one head plate portion is a one-piece cap-like member which is mounted to commonly cover all of said plunger cases.

20. A high-pressure reciprocating pump according to claim 15, wherein said seal includes:

laminated seal members, each fitted in an annular groove formed between the inside surface of each of said plunger cases and a corresponding one of said plungers;

a coil spring mounted between said laminated seal members and a bottom of said annular groove; and a tightening device located at one end of said laminated seal members opposite to said coil spring by which tightening pressure can be exerted on said laminated seal members against a pushing force exerted by said coil spring.

21. A high-pressure reciprocating pump according to claim 20, wherein said laminated seal members include a plurality of ramie seals and backup rings alternately stacked along an axis of each of said plungers.

* * * * *

UNITED STATES PATENT AND TRADEMARK OFFICE

CERTIFICATE OF CORRECTION

PATENT NO. : 6,171,070 B1
DATED : January 9, 2001
INVENTOR(S) : Kazutoshi Mitaki It is certified that error appears in the above-identified patent and that said Letters Patent is hereby corrected as shown below:

Title page,
Item [73], insert the name of the first Assignee as follows:
-- Genus Corporation, Tokyo-to, Japan --.
Correct the name of the second Assignee as follows:
-- Hakusui Tech Co., Ltd., Osaka-fu, Japan --.

Signed and Sealed this

Seventeenth Day of December, 2002

JAMES E. ROGAN
*Director of the United States Patent and Trademark Office*